US011639256B2

(12) United States Patent
Anderson

(10) Patent No.: US 11,639,256 B2
(45) Date of Patent: May 2, 2023

(54) NON-ROLL STICK PRODUCT CONTAINERS

(71) Applicant: Raymond G. Anderson, Ankeny, IA (US)

(72) Inventor: Raymond G. Anderson, Ankeny, IA (US)

( * ) Notice: Subject to any disclaimer, the term of this patent is extended or adjusted under 35 U.S.C. 154(b) by 247 days.

(21) Appl. No.: 17/001,891

(22) Filed: Aug. 25, 2020

(65) Prior Publication Data

US 2022/0063878 A1 Mar. 3, 2022

(51) Int. Cl.

| | |
|---|---|
| ***B65D 51/24*** | (2006.01) |
| ***A45D 40/06*** | (2006.01) |
| ***B65D 41/02*** | (2006.01) |
| ***B65D 83/00*** | (2006.01) |

(52) U.S. Cl.

CPC ..... *B65D 51/249* (2013.01); *A45D 40/06* (2013.01); *B65D 41/02* (2013.01); *B65D 83/0011* (2013.01)

(58) Field of Classification Search

CPC ..... Y10S 242/905; A45D 40/10; A45D 40/02; A45D 40/205; A45D 40/06; B65D 77/08; B65D 75/327; B65D 35/04; B65D 35/22; B65D 51/249; B65D 41/02; B65D 83/0011

See application file for complete search history.

(56) References Cited

U.S. PATENT DOCUMENTS

| | | | | |
|---|---|---|---|---|
| 1,640,386 | A * | 8/1927 | Wayne | A45D 40/02 401/61 |
| 2,442,109 | A * | 5/1948 | Anderson | A45D 40/06 401/74 |
| 2,471,483 | A | 7/1949 | Frydlender | |
| 2,626,048 | A * | 1/1953 | Rosen | A45D 40/06 401/62 |
| 3,091,329 | A * | 5/1963 | Levine | A45D 40/06 401/78 |
| 4,505,607 | A * | 3/1985 | Sugiyama | A45D 40/06 401/98 |
| 4,961,663 | A * | 10/1990 | Iwamoto | A45D 40/16 401/86 |
| 5,215,204 | A | 6/1993 | Beck et al. | |
| 6,048,121 | A | 4/2000 | Carver | |
| 6,409,403 | B1 | 6/2002 | Woos | |
| 7,293,926 | B2 * | 11/2007 | Gueret | A45D 40/10 401/74 |
| 7,549,559 | B2 | 6/2009 | Conroy et al. | |
| 7,566,185 | B2 | 7/2009 | Samuelson et al. | |
| 7,798,356 | B2 | 9/2010 | Kobayashi et al. | |
| 8,973,754 | B2 * | 3/2015 | Ahmed | A45D 44/18 132/321 |
| 10,231,529 | B2 | 3/2019 | Anderson | |
| 11,241,709 | B1 * | 2/2022 | May | B05C 17/00 |

(Continued)

*Primary Examiner* — Kareen K Thomas

(74) *Attorney, Agent, or Firm* — Zarley Law Firm, P.L.C.

(57) ABSTRACT

The present invention relates to three stick product containers. One has a removable top cap with a crown and a hollow base, such that the top cap can be removed and inserted into the hollow base. The top cap has associated with it a thumb lever push ring to prevent the stick from rolling when laid horizontal. The other container is more suitable, for example, for a lip balm that has a top cap with a living hinge that can be flipped all the way back, inserted into a plug insert hole in the base of the cap, and then the cap is used to support the container in an at rest position to prevent it from rolling.

18 Claims, 6 Drawing Sheets

(56) References Cited

U.S. PATENT DOCUMENTS

| | | | | |
|---|---|---|---|---|
| 2004/0233629 | A1* | 11/2004 | Wang | H05K 5/0278 361/679.4 |
| 2008/0175649 | A1* | 7/2008 | Lee | B43K 5/005 401/192 |
| 2011/0229244 | A1* | 9/2011 | Bennett | A45D 40/04 401/55 |
| 2015/0191041 | A1* | 7/2015 | Slevin | B43M 11/06 401/48 |
| 2015/0366321 | A1* | 12/2015 | Anderson | A61M 35/003 401/55 |
| 2019/0380378 | A1* | 12/2019 | Partain | A24B 15/34 |
| 2020/0230998 | A1* | 7/2020 | Edekar | B43K 29/004 |

* cited by examiner

NON-ROLL STICK PRODUCT CONTAINERS

BACKGROUND OF THE INVENTION

This invention relates to three distinct types of stick product containers for dispensing stick products such as glue, lip balm, sunscreen, or deodorant. The specific type of product is not limiting. Particularly the invention relates to a stick product container with an improved cap design.

Stick products such as but not limited to those for lip balms, sun screens, deodorants, and glue are known. They generally involve a cylindrical housing, a bottom or a base in one end of the housing and a cap on the other. The product is contained inside and is dispensed by one mechanical means or another when the cap is removed. Some have mechanical mechanisms for twisting the base of the cylinder to push out the stick product, others simply push out. Mechanical mechanisms to urge the product towards the top end of the cylinder are well known and need not be described herein.

A particular problem with such stick product containers is difficulty in removing the cap and/or once the cap is removed the cap is often lost, misplaced, simply left off or rolls away from the user. The container easily rolls away as well. The result is that the product inside of the cylindrical barrel or housing dries making it worthless. The present invention solves this and other problems.

SUMMARY OF THE INVENTION

The present invention relates to three stick product containers. One has a removable top cap with a crown and a hollow base, such that the top cap can be removed and inserted into the hollow base. Preferably the top cap has associated with it a thumb lever push ring to make it easier to remove the lid and prevent the stick from rolling when laid horizontal. Another container is more suitable, for example, for a lip balm that has a top cap with a living hinge that can be flipped all the way back, inserted into a plug insert hole in the base of the cap, and then the cap is used to support the container in an at rest position to prevent it from rolling. Yet another container has a removable cap having a living hinge that can be flipped back and inserted in a hole on the base of the cap.

DETAILED DESCRIPTION OF THE PREFERRED EMBODIMENTS

Figure 1:
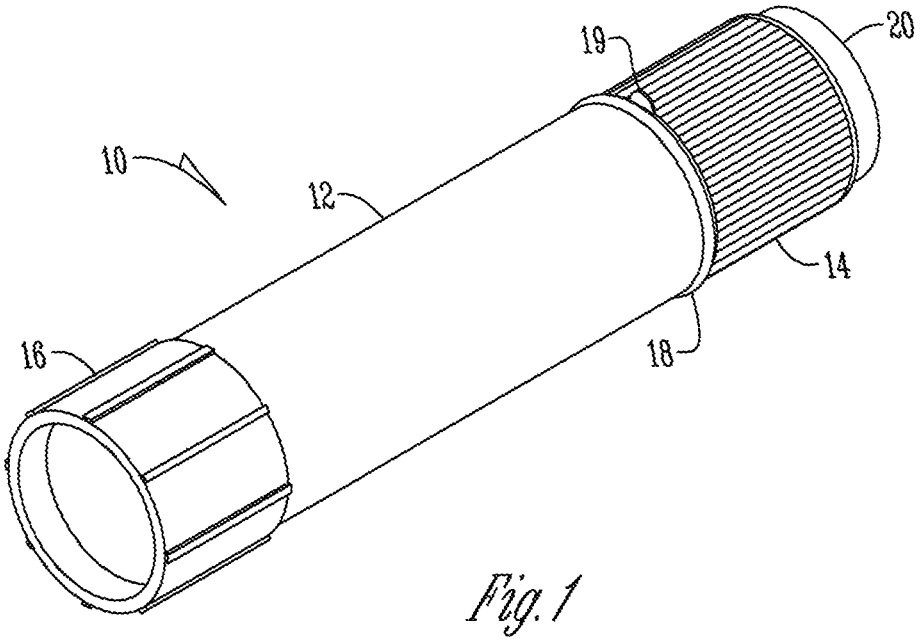
FIG. 1 is a side elevational view of a non-roll stick product container in accordance with the present invention.
Figure 2:
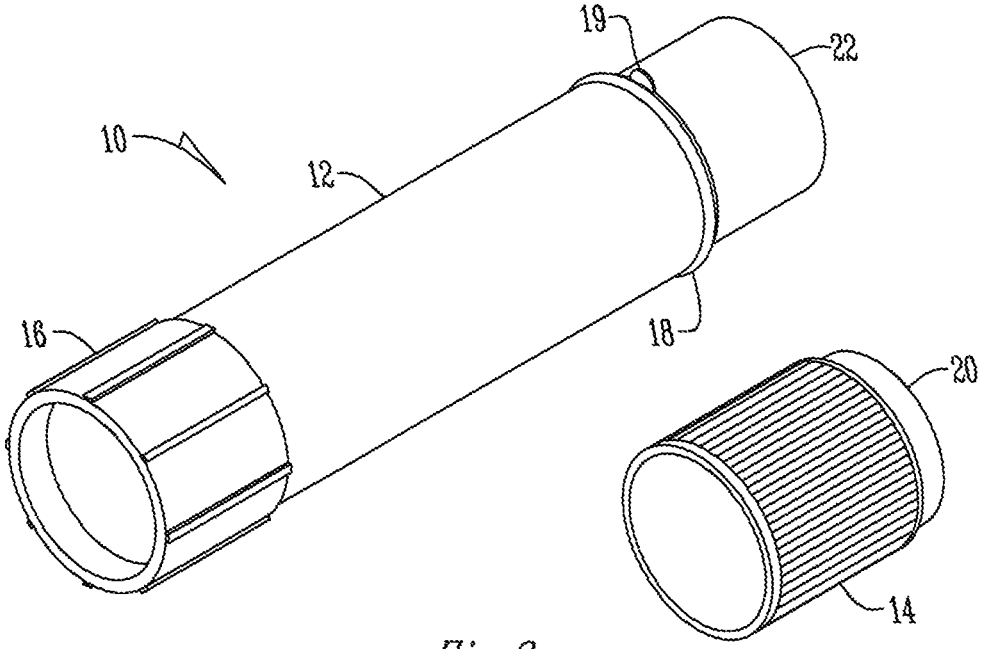
FIG. 2 is a side elevational view with the front (top) cap off.
Figure 3:
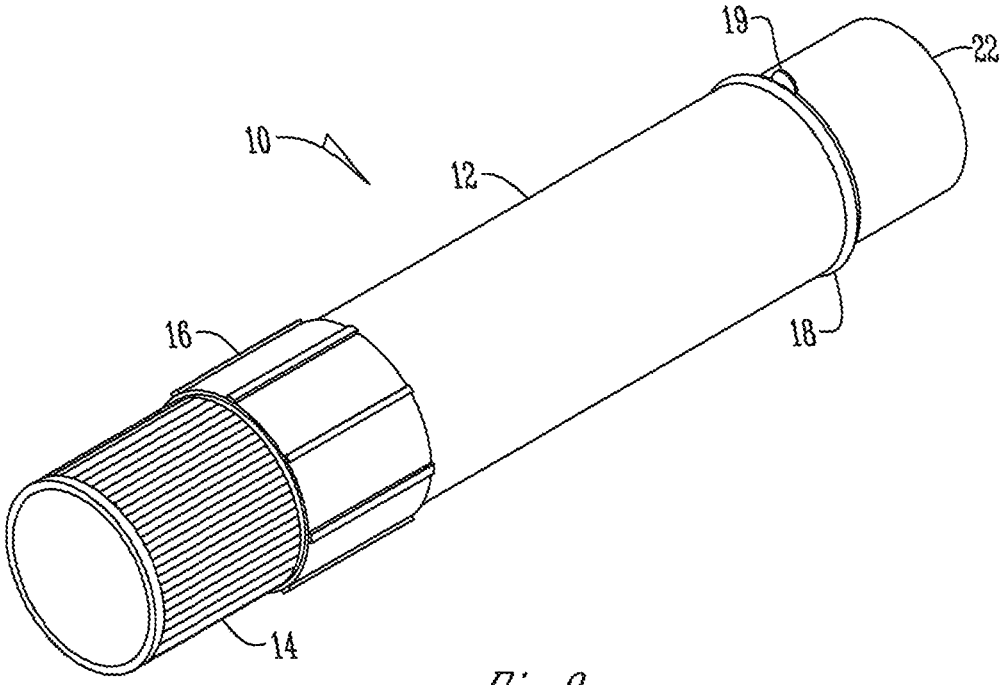
FIG. 3 is a side elevational view with the front cap off and inserted in the hollow bottom so that the container may stand on its own.
Figure 4:
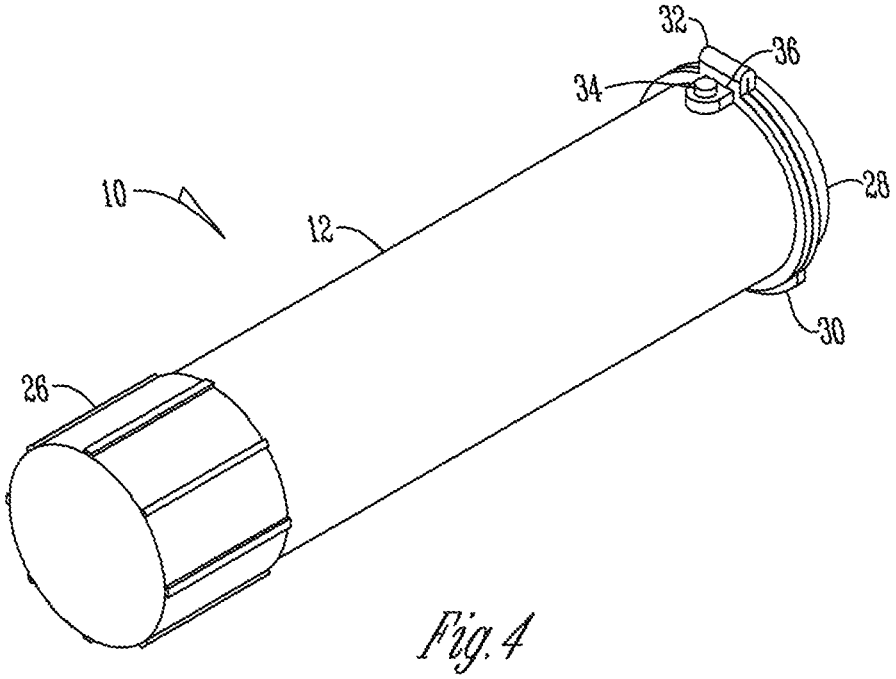
FIG. 4 is a standing view of a non-roll stick product container embodiment of the invention with its flip top cap closed.
Figure 5:
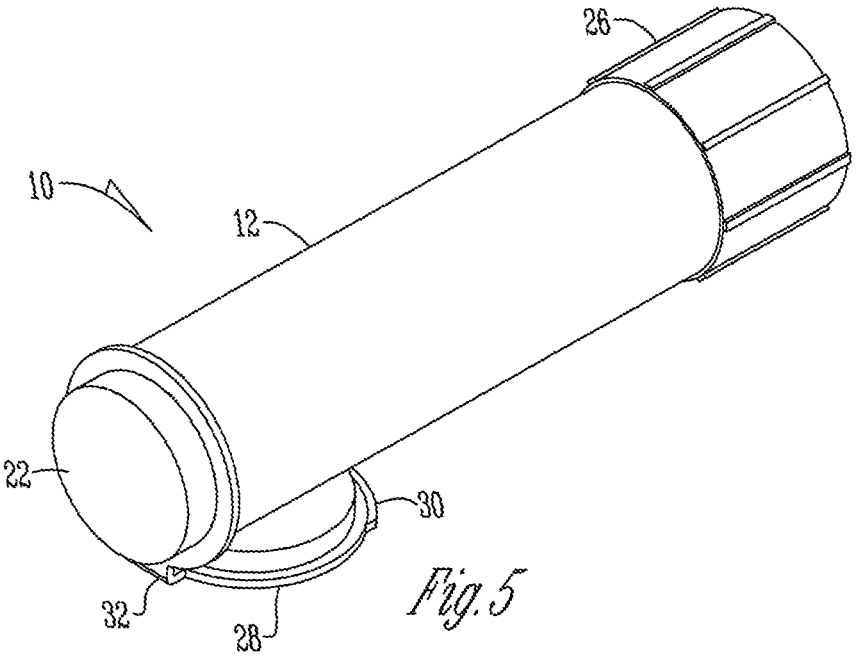
FIG. 5 shows the FIG. 4 container with the flip cap open and in at rest positioned to hold the container in a horizontal position when at rest.
Figure 6:
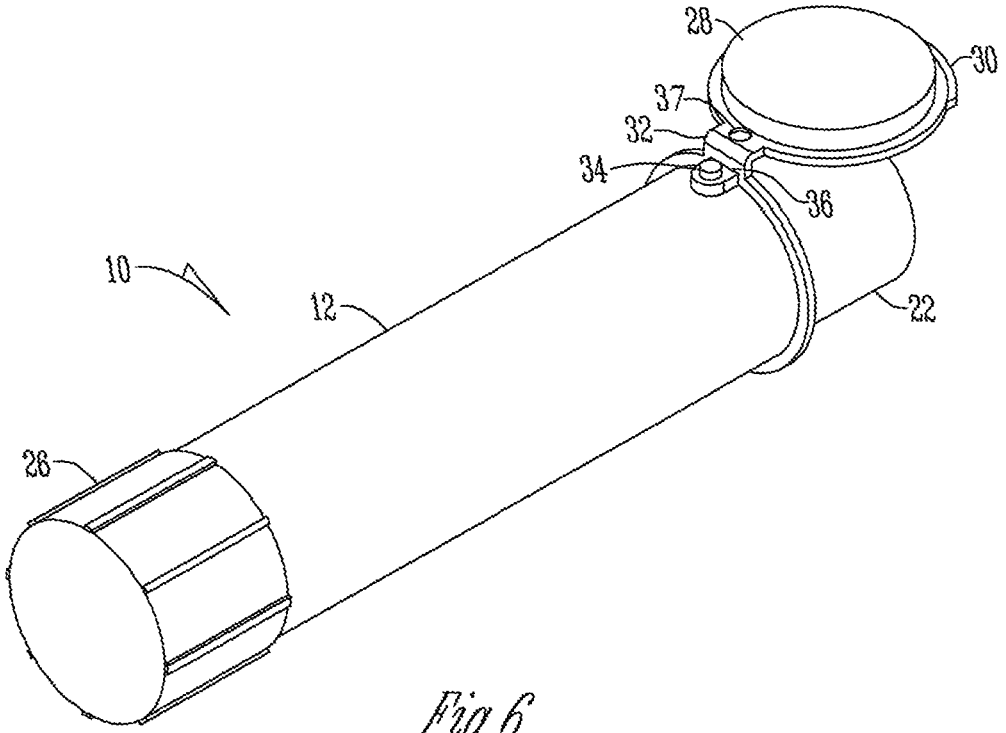
FIG. 6 shows the cap of the non-roll stick container embodiment open and in a standing position to show the living hinge, the plug hole, and the plug of the cap.

Referring now in greater detail to the drawings, first FIGS. 1-3 and then next FIGS. 4,5, and 6. Stick product container 10 is shown in a closed configuration in FIG. 1. Generally it comprises a cylindrical housing 12, a cap 14 which is removable and a bottom end 16 or base 16 which is non-removable and closes off the end of cylinder 12. Below the cap 14 and on the cylinder 12 is a thumb lever push-ring 18. The push-ring includes an outwardly extending tab 19. Cap 14 has on its top end a crown 20. The housing 12 may be circular in cross section, oval, rectangular or triangle.

FIG. 2 shows the cap 14 removed to expose the stick product 22. As earlier stated stick product 22 is not a limiting feature of the invention and it may be lip balm, sunscreen, deodorant, glue or other cosmetic, medicinal, or adhesive products. Those skilled in the art know for stick products that lend themselves to a more rigid structure it is typical for the product 10 to have a mechanism to urge the product towards the top end of the cylinder, often operatively engaged by twisting the bottom end or base 16. Such mechanisms are well known and need not be described in detail herein. Push-ring 18 has a thumb lever or tab 19 associated with it which may be pushed up to force the cap to dislodge from product 22 for easy removal. The push ring prevents rolling of the container. Cap 14 has a crown 20 fixed to it in a non-removable manner.

As illustrated in FIG. 3 crown 20 can be inserted into the hollow bottom end or base 16 with the crown 20 matingly fitting into the hollow end of bottom or base 16 so that it removably holds in position. As a result the cap 14 does not fall off or roll around. The product can be kept from rolling by resting on the thumb lever push ring.

The optional mechanism for moving the product upward when twisting the bottom end or base 16 can be a conventional screw mechanism inside of cylinder housing 12, so that when the cap or base 16 is turned a stick product 22 may advance upwardly, making more product available for use.

Figure 7:
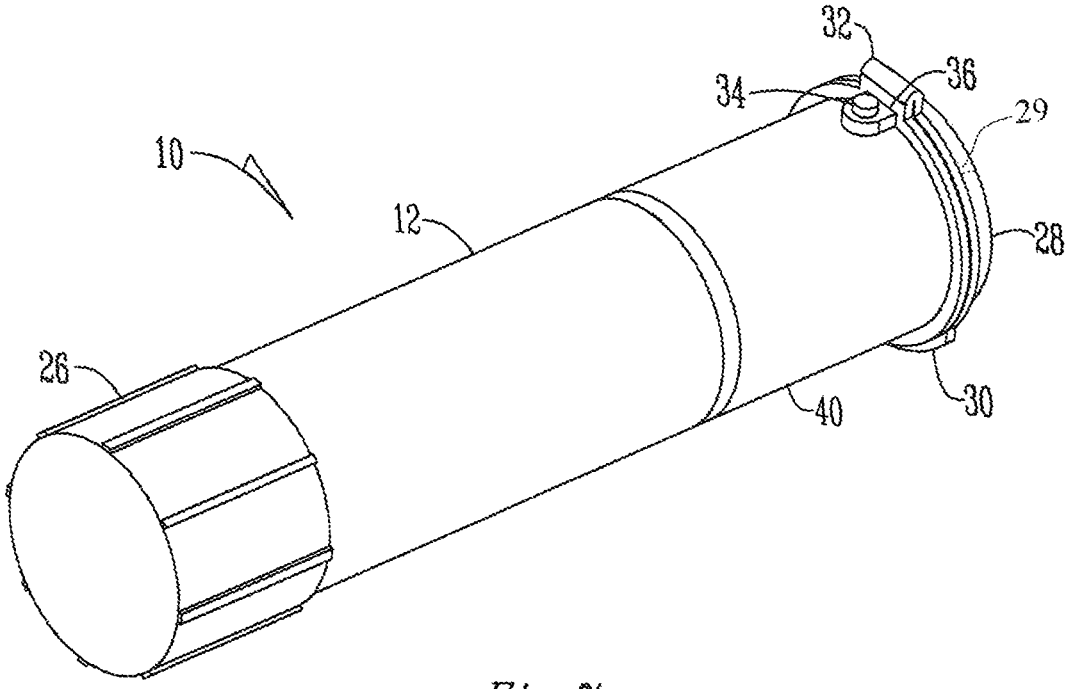
FIG. 7 is a side sectional view of a container and separate flip top cap.
Figure 8:
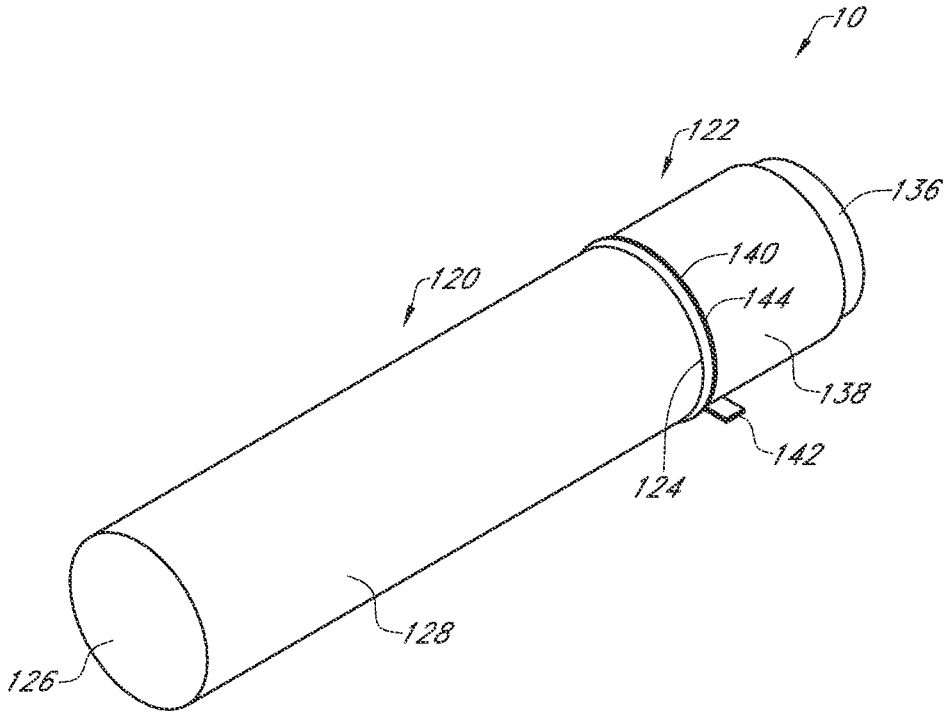
FIG. 8 is a perspective view of a container.
Figure 9:
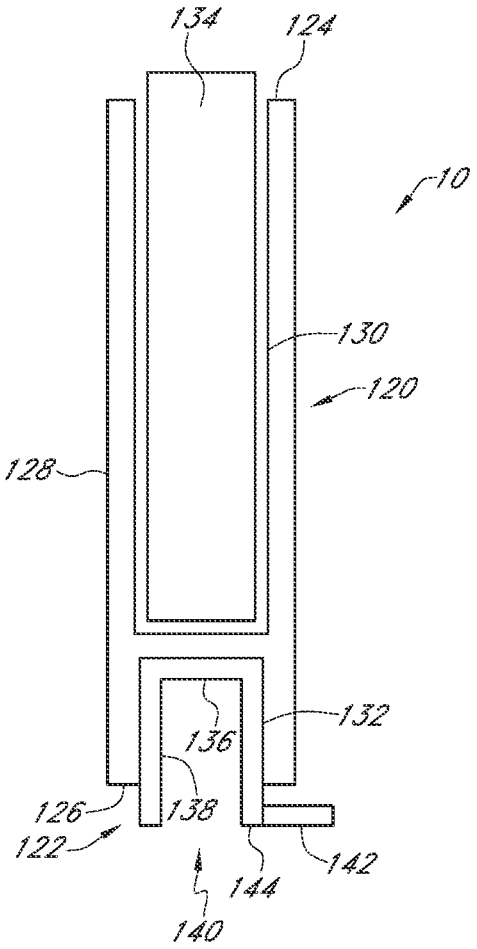
FIG. 9 is a side sectional view of a container.

A product dispenser, particularly suitable for a stick product such as lip balm or glue stick is shown in FIGS. 4, 5 and 6. It operates mechanically similarly but has a means of closure. In particular it has similar parts, a cylindrical barrel 12 and a twist base 26, top cap 28 and a thumb release 30, and as well a living hinge 32. The cylinder barrel 12 and flip cap 28 are made of one piece (as in FIG. 4) or multiple pieces (as in FIG. 7). Also, as shown in FIG. 7, the cap 28 may extend outwardly from the cylinder to form a cavity 29 that allows product to remain extended when the cap 28 is closed. Under the living hinge but still on the cap is an insert or lock plug 34. Hinge 32 has an insert base 36 which when thumb release 30 is pushed upwardly and cap 28 moves up and away, then the insert plug 34 fits into the insert hole 36 of hinge 32 and locks it into a rest position shown in FIG. 5 so that the container 10 can rest on cap 28 as depicted in FIG. 5, and also prevent losing the cap or rolling away. Insert lock plug 34 friction fits into insert hole 36 and may simply be pulled out from the same in order to allow the living hinge to function to close the stick product container as needed or desired as shown in closed position in FIG. 6 and opened in a non-rolling at rest position in FIG. 5. In FIG. 4 the cap 28 is attached to the housing 12 by hinge 32. FIG. 7 shows an alternative embodiment where the cap 28 has a collar 40 that snuggly fits around one end of the housing 12. The cap 28 is connected to the collar 40 by hinge 32.

In yet another embodiment, the container 10 has a housing 120 and a cap 122 removably attached to the housing 120. The housing has a first open end 124, a second open end 126, and a side wall 128 that forms at least one, and preferably two hollow chambers 130 and 132. The first hollow chamber 130 is adapted to receive a stick product 134 and the second hollow chamber 132 is adapted to receive the cap 122 as will be explained further below.

The cap 122 has a top wall 136, a side wall 138 and an open bottom 140. The cap 122 is attached to the housing 120 in any manner, but preferably is attached through a friction fit. Extending outwardly, and generally perpendicular, from the side wall 138 of the cap 122, is a projection or flange 142. The projection 142 does not extend all the way around the side wall 138 of the housing 120. Preferably the projection 142 is positioned adjacent a lower edge 144 of the side wall 138. The projection 142 also is preferably flat and has a length greater than its width. The projection is of a size and shape that is adapted to prevent the container 10 from rolling when placed lengthwise on a surface.

The top wall 136 of the cap 122 is adapted to be received and secured within the second hollow chamber 132 of housing 120. When inserted within the second hollow chamber 132, the projection 142 remains outside the hollow chamber 132 and beyond the second open end 126 of the housing so that when secured, the projection prevents the container from rolling on a surface.

In operation, when the cap 122 is attached to the housing 120, and the container is lying on a surface, the container is prevented from rolling by the engagement of the projection 142 with the surface. The cap 122 is removed from the housing 120 by applying manual pressure on the cap 122. Force on the projection 142 can also be applied to assist in removing the cap 122.

Once removed, the top wall 136 is inserted within the second hollow chamber 132 such that the projection 142 outside of the hollow chamber 132 and beyond the second open end 126 of the housing. In this position, the projection 142 again engages the surface to prevent the container from rolling.

It is to be understood that the preferred embodiments here described are a illustrative only and that the invention is intended to include all the modifications and so far as they come within the scope of the impendent claims or the equivalence thereof.

What is claimed is:

1. A container comprising:

a housing having a first open end, a second open end, and a side wall that forms at least one hollow chamber;

a cap having a top wall, a side wall and an open bottom removably connected to the housing; and a projection that extends outwardly from the side wall of the cap and is adapted to prevent the container from rolling on a surface;

wherein the cap is configured to be received and secured over the first open end of the housing such that the housing is received within the cap;

wherein the cap is configured to be received and secured within the second open end of the housing such that the top wall of the cap is received within the at least one hollow chamber; and wherein when the cap is received within the second open end, the projection remains outside the at least one hollow chamber and beyond the second open end.

2. The container of claim 1 wherein the projection is positioned adjacent a lower edge of the side wall of the cap.

3. The container of claim 1 wherein the at least one hollow chamber comprises a first hollow chamber and a second hollow chamber and the cap is adapted to be received within the second hollow chamber.

4. The container of claim 3 wherein the projection is positioned outside of the second hollow chamber and beyond the second open end of the housing and is adapted to prevent the container from rolling on the surface.

5. The container of claim 3 further comprising a stick product positioned within the first hollow chamber.

6. The container of claim 1 wherein the projection extends generally perpendicular to the side wall of the cap.

7. The container of claim 1 wherein the projection extends adjacent only a lower edge of the side wall.

8. The container of claim 1 wherein the projection is flat.

9. The container of claim 8 wherein the projection has a length greater than a width of the projection.

10. A container comprising:

a housing having a first open end, a second open end, and a side wall;

the housing having a first hollow chamber that extends inwardly from the second open end towards the first open end;

a cap having a top wall, a side wall, and an open bottom;

a projection extending outwardly from the side wall of the cap adjacent a lower edge of the cap; and wherein the cap is configured to be received over the first open end of the housing by receiving the first open end of the housing through the open bottom of the cap;

wherein the cap is configured to be received through the second open end of the housing such that the top wall of the cap is positioned within the first hollow chamber;

wherein the projection is configured to remain outside the first hollow chamber and beyond the second open end when the cap is received through the second open end of the housing.

11. The container of claim 10 wherein the projection is configured to prevent the container from rolling when the cap is received over the first open end and when the cap is received within a second hollow chamber.

12. The container of claim 10 wherein the projection is flat, extends generally perpendicular to the side wall of the cap, and is positioned adjacent only the lower edge of the side wall.

13. The container of claim 10 further comprising the housing having a second hollow chamber.

14. The container of claim 13 further comprising a stick product received within the second hollow chamber.

15. A container comprising:

a housing;

a cap removably attached to the housing;

the housing having first open end, a second open end, and a side wall;

a first hollow chamber formed by the first open end and the side wall;

a second hollow chamber formed by the second open end and the side wall;

a stick product received within the first hollow chamber;

the cap having a top wall, a side wall, and an open bottom; and a flange extending outwardly from the cap adjacent a lower edge of the cap in a generally perpendicular direction in relation to the side wall;

wherein the cap is configured to be received over the first open end of the housing by receiving the first open end of the housing through the open bottom of the cap;

wherein the cap is configured to be received through the second open end of the housing such that the top wall of the cap is positioned within the second hollow chamber;

wherein the flange is configured to remain outside the second hollow chamber and beyond the second open end when the cap is received through the second open end of the housing;

wherein the flange is configured to prevent the container from rolling when the cap is received over the first open end and when the cap is received within the second hollow chamber.

16. The container of claim 15 wherein the flange does not extend completely around the side wall of the housing.

17. The container of claim 16 wherein the flange is flat and has a length greater than a width of the flange.

18. The container of claim 17 wherein the cap is secured over the first open end of the housing by a friction fit.

* * * * *